United States Patent [19]

Landis

[11] Patent Number: 4,826,039

[45] Date of Patent: May 2, 1989

[54] CONTAINER CLOSURE WITH ANTI-NESTING RIBS

[75] Inventor: H. Richard Landis, Oak Lawn, Ill.

[73] Assignee: Landis Plastics, Inc., Chicago Ridge, Ill.

[21] Appl. No.: 152,527

[22] Filed: Feb. 5, 1988

Related U.S. Application Data

[63] Continuation-in-part of Ser. No. 101,039, Sep. 25, 1987.

[51] Int. Cl.[4] ..... B65D 43/03; B65D 55/00

[52] U.S. Cl. ..... 220/380; 220/306

[58] Field of Search ..... 220/306, 380; 206/503, 206/508

[56] References Cited

U.S. PATENT DOCUMENTS 4,296,871 10/1981 Andersson ..... 220/380

4,660,735 4/1987 Peschardt et al. ..... 220/306

*Primary Examiner*—George T. Hall

*Attorney, Agent, or Firm*—Fitch, Even, Tabin & Flannery

[57] ABSTRACT

Disclosed is a plastic injection molded closure having a plug-like section and an outer skirt. The plug-like section includes a vertical cylindrical wall having upper and lower annular nesting surfaces for nesting containers in a stack. An annular top wall outwardly extends from the vertical cylindrical wall upper end and a skirt depends downwardly from the outer periphery of the outer top wall. The lower free end of the skirt includes a bead defining a thick cross-sectional area on the skirt for engaging the upper flange of a container when mated therewith. The container upper flange extends outwardly and downwardly from the open end of the container and has a free end engaging the bead on the closure skirt. A plurality of radially inwardly directed ribs extend from the cylindrical wall and present upper surfaces to a superimposed closure that may be stacked therewith. The ribs, and particularly their upper surfaces prevent penetration of a superior closure into a cavity formed by the cylindrical wall, and thereby prevent wedging engagement with the superior closure and at least the upper portion of that cylindrical wall. The upper rib surfaces are located interiorly within the cavity and do not interfer with the long outer vertical plug sealing surface that engages the container.

7 Claims, 1 Drawing Sheet

CONTAINER CLOSURE WITH ANTI-NESTING RIBS

RELATED APPLICATIONS

This application is a continuation-in-part of U.S. patent application Ser. No. 101,039, filed Sept. 25, 1987, which is herein incorporated by reference.

BACKGROUND OF THE INVENTION

1. Field of the Invention

The present invention pertains to injection molded closures, and in particular, to such closures having means to prevent their jamming together when stacked one on top of the other.

2. Description of the Prior Art

Food products such as cottage cheese, sour cream dressing or the like dairy products are currently packaged in plastic containers having thermoformed plastic lids or closures therefor. These thermoformed lids characteristically have what is commonly termed a "plug fit", referring to a recessed plug-like central portion for insertion within, and to have tight frictional engagement with, the interior slanted surface of the container. The thermoformed closures require a secondary, post-forming operation after molding, in which an interior locking bead is formed on a deep skirt located at the upper end of the closure. The plug-like closures are distinguished from the closure of U.S. Pat. No. 3,933,264, for example, which has a circular central panel forming part of the uppermost surface of the closure. The central panel is joined to a collar-like container-engaging portion through an inclined wall, and by occasional triangular-shaped gussets which strengthen the connection between the upper panel and the outer container-engaging portion.

U.S. patent application Ser. No. 101,039, filed Sept. 25, 1987, discloses an injection molded closure which can serve as a direct replacement of thermoformed closures, and which is also suitable for use with existing packaging equipment designed for the mass, automatic filling and closing of thermoformed containers.

It is important that closures supplied for use with automated packaging equipment be arranged in a predictably oriented manner with respect to each other when placed in a stack. In particular, it is important that wedging between adjacent closures be avoided such that the existing packaging equipment for thermoformed lids can be used without sheet-down because of failure of the lids to be automatically removed and applied with sealing engagement with the filled container. As discussed in U.S. patent application Ser. No. 101,039 filed Sept. 25, 1987, the following U.S. patents are directed to lids which may be stacked one with another, but which are generally unsatisfactory for use with the container described in that application: 4,037,748; 4,046,282; 4,079,857; 4,103,803; 4,111,329; 4,165,020; 4,252,248; 4,418,833; and 4,682,706. The aforementioned U.S. patent application Ser. No. 101,039, filed Sept. 25, 1987, offered significant improvements in providing closures having protection against jamming when nested together in a stack, and further refinements are still being sought, especially with the increasing emphasis on automated packaging.

SUMMARY OF THE INVENTION

Accordingly, it is an object of the present invention to provide an injection molded closure having a plug portion and an encircling skirt having improved protection against jamming when nested or stacked with other lids.

These and other objects of the present invention which will become apparent from studying the appended description and drawings are provided in an injection molded plastic closure for application to a container having a sidewall with a rim at its upper end defining an open mouth. The closure has a top central circular panel for covering an open container and a plug-like portion upwardly extending from the central circular panel. The plug-like portion, which includes a generally upright sidewall defining an upwardly-facing socket-like cavity bounded at its upper end by an upper portion of the sidewall, is inserted into the open mouth of the container for sealing engagement with the container sidewall. An encircling rim having an outwardly depending skirt, extends radially outwardly from the cylindrical upright. A bead is provided at the lower portion of the skirt for locking engagement with the container rim. A plurality of spaced-apart ribs are provided which extend inwardly from the cylindrical sidewall. The ribs contact a plug-like portion of another closure at a plurality of spaced contact points when the other plug-like portion is inserted within the cavity, so as to prevent a wedged engagement of the other closure with the sidewall.

BRIEF DESCRIPTION OF THE DRAWINGS

In the drawings, wherein like elements are referenced alike.

DETAILED DESCRIPTION OF THE PREFERRED EMBODIMENT

Figure 1:
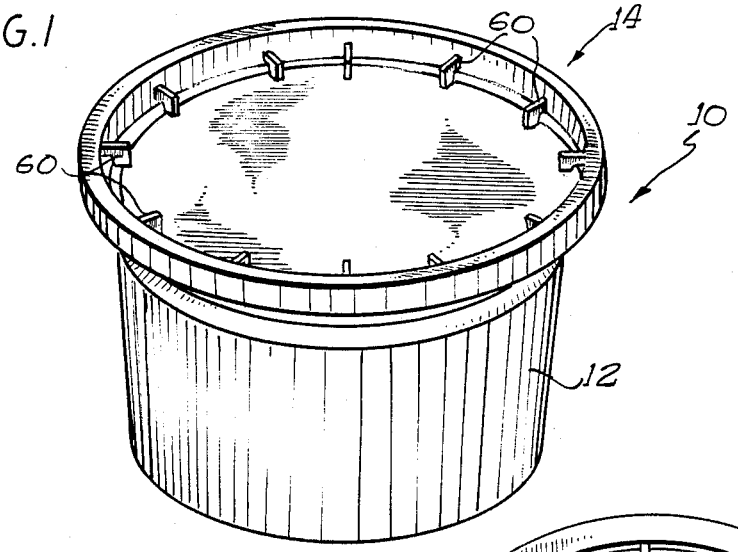
FIG. 1 is a perspective view of a container and closure assembly illustrating aspects of the present invention.

Referring to the drawings, FIG. 1 illustrates an assembly 10 comprising a container 12 and a closure or lid 14. The container and lid of the preferred embodiment preferably have a configuration resembling that of containers used in the dairy industry for packaging cottage cheese, sour cream dressing or the like. These assemblies have traditionally been manufactured from a thin sheet of styrene using thermoforming and secondary post-forming techniques to form a very thin, flexible lid of uniform cross-sectional thickness. As distinguished therefrom, the lid of the preferred embodiment is constructed of polyethylene using injection molding techniques to form a more rigid lid having cross sections of different thicknesses to provide more rigidity and to provide a lid which does not require post-forming or other secondary operations. As a result, the container and lid are substantially stronger than prior art thermoformed styrene container assemblies and have improved strength and resilient locking features. Although the lid is relatively strong, it is nonetheless quite pliable because of the overall thin wall sections and large diameter. This injection molded lid is intended to be overall dimensionally interchangeable with the thermoformed lid so that the same packaging equipment may be used to handle the new injection molded lid.

Figure 2:
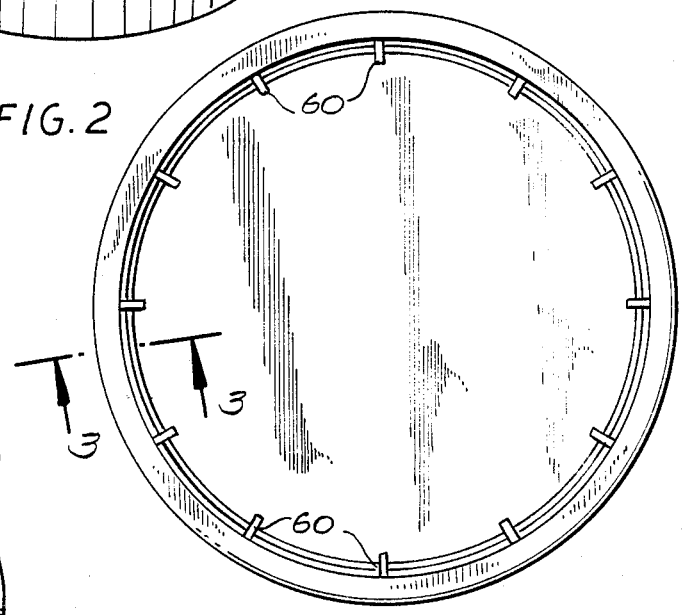
FIG. 2 is a top plan view of the closure of FIG. 1.
Figure 4:
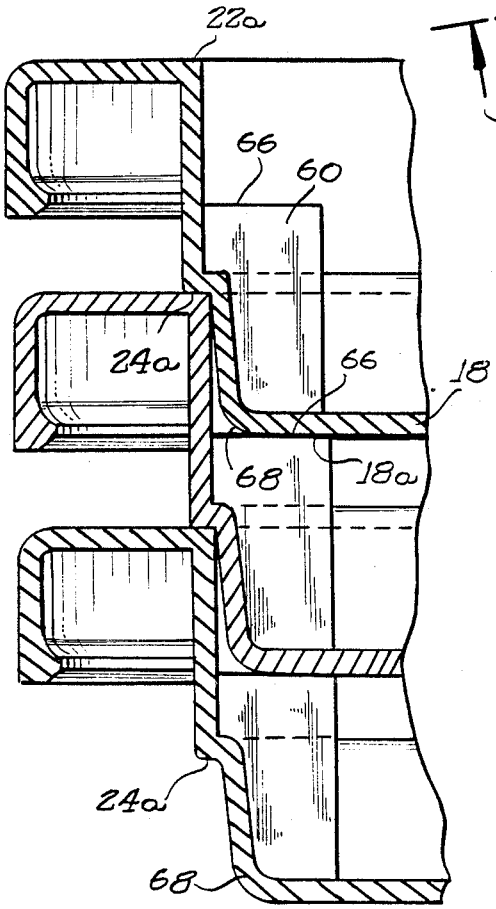
FIG. 4 is a fragmentary cross-sectional view of a plurality of nested closures, stacked one on top of the other.
Figure 3:
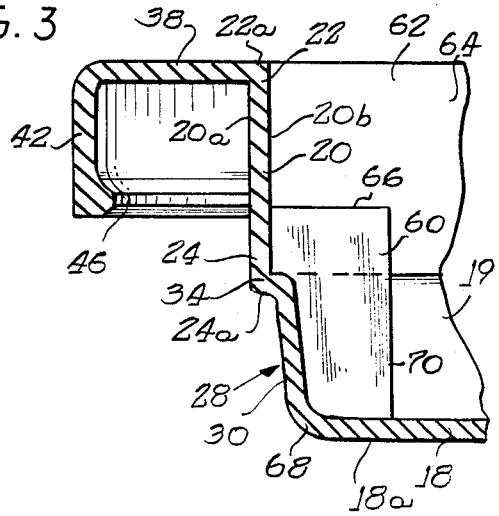
FIG. 3 is a fragmentary cross-sectional view taken along the line 3—3 of FIG. 2 and looking in the direction of the arrows.

The lid of the preferred embodiment to which the present invention is directed, is characterized by an outer encircling skirt and an inner central portion providing a plug-type fit with its mating container. Referring now to FIGS. 2–3, the lid 14 includes a central disk-like panel bottom or wall 18 having an outer generally circular periphery and forming the bottom of a central plug-like portion 19 which, as will be seen, encloses the major portion of the container opening. Lid 14 further includes a vertical substantially cylindrical side wall 20 having an upper end 22 and a lower end 24. Side wall 20 also has external and internal surfaces **20*a*, 20*b*, respectively (see FIG. 3) which are preferably parallel to each other and which have no draft, that is the surfaces 20*a* and 20*b* are preferably at a true vertical without any inclination, that would interfere with removal of the vertical plug well 20 from the injection molds (not shown). It is contemplated that the interior surface 20*b* may be slanted to assist in release from the mold. Alternatively, the external wall surface could be drafted, i.e. at a slant, to effect mold release. A typical draft would be 1° to 5° for mold release. Alternatively, the upright wall could be slightly slanted, i.e. canted in either direction to the vertical, particularly because of the anti-nesting feature described below. Whether straight vertical or slightly slanted to the vertical, the vertical plug walls 20** may be stacked in a strong vertical column as shown in FIG. 4.

The lower end 24 of cylindrical plug wall 20 is connected to the outer periphery of bottom wall 18 by an inwardly extending frustoconical portion 28 having a frustoconical wall 30 and a horizontal annular wall or ledge 34 between the vertical wall 20 and the frustoconical wall 30. The latter has a lower end which is blended into the outer periphery of bottom wall 18. Thus, the upper end of frustoconical wall 30 is preferably connected to side wall 20 through a short generally lateral, perpendicular or radially-directed ledge 34 which is generally parallel to the bottom wall 18. The ledge 34 provides an annular nesting surface **24*a*, (see FIGS. 3 and 4) located at the lower end of side wall 20. As will be seen, nesting surface 24*a* engages an upper nesting surface 22*a* on the upper end 22 of the cylindrical side wall 20** of a lower lid nested or stacked therewith.

The plug wall 20 is preferably a substantially true vertical wall but may a small draft or inclination to the vertical.

Referring again to the upper end of lid 14, an annular, generally horizontal top wall 38 extends outwardly from the upper end 22 of cylindrical side wall 20. The top wall 38 and upper end 22 of cylindrical side wall 20 together form an upper flat nesting surface on the lid 14, and the advantage of this feature will become apparent when nesting of the lids is considered. A generally vertical skirt 42 depends downwardly from the outer periphery of top wall 38 and has a lower free end which includes an inwardly extending bead 46 which has a cross sectional thickness substantially greater than the wall thickness of the skirt 42. This thicker, encircling bead adds rigidity and strength to the rim portion of the lid. As illustrated, the skirt 42 is preferably cylindrical in configuration and is generally vertically oriented. The cylindrical side wall 20, top wall 38 and skirt 42 form a downwardly opening channel for receiving the upper end or annular rim of container 12 when mated therewith (see FIG. 3).

The thermoformed lids are nested and removed automatically from the stack by the packaging equipment; and it is essential that the lid 14 be nested in stacks in a manner which allows the ready release and handling by the same packaging equipment. As illustrated in FIG. 4, a stack of inter-nested lids 14 have their cylindrical sidewalls 20 aligned end to end, with the lower nesting surface **24*a* on an upper lid engaging the upper nesting surface 22*a* of the side wall 20 of another lid located immediately therebelow. As shown in FIG. 4, the straight, vertical walls 20** are aligned vertically and in a vertical column. Thus, the lids have straight cylindrical walls which cumulatively define a straight vertical cylinder divided into a stack of cylindrical strips, i.e. a composite cylinder thereby providing rigidity to the stack of lids.

While the lids generally nest in the manner shown in FIG. 4, it sometime occurs that the upper portion of the vertical wall 20 is flexed radially outwardly to form a larger diameter section which allows the overhead nesting surface **24*a* to drop down into the enlarged cavity and to become wedged or jammed therein. The lids at the upper edge of the wall 20** are quite wide in diameter and are pliable because of this diameter. The thin wall thickness, and the low density polyethylene material used for the lid.

According to principles of the present invention, additional anti-jamming protection is provided for nested lids to prevent there being significantly misaligned one with another during a cup feeding process. As illustrated in FIGS. 1–4, the additional protection is provided, in part, by a plurality of ribs 60 located within the interior of the upwardly-opening central cavity or recessed portion 62 of lid 14 to limit the downward movement of the nesting shoulder **24*a* if the vertical wall 20 should be expanded to increase the size of the cavity or recessed portion 62. The recessed portion 62 includes not only the plug-like portion 19, but also an upper annular recess 64 formed thereabove by sidewall 20**.

As seen most readily in FIGS. 1 and 2, the plurality of ribs 60 are provided in the central recess of lid 14, and are oriented in generally inward and preferably radially extending directions. For example, twelve equally-spaced ribs are provided in the lid illustrated in FIGS. 1 and 2. In general, the ribs 60 aid in preventing jamming of lids 14 which are so misaligned one from the other, that the nesting surfaces **22*a*, 24*a* of adjacent lids are not brought into contact with one another, as one lid contacts another. In particular, ribs 60 are especially useful in preventing a jamming between adjacent stacked lids when, for example, an upper lid is significantly tilted from a lower lid and is also significantly laterally offset from the lower lid such that portions of the cylindrical wall 20 of the upper lid pass below the upper nesting surface 22*a* of the lid so as to be partially received in the recess portion 62** thereof. As will be seen in the exemplar lid described below, the lid is, to some extent, flexible so as to be somewhat susceptible to deformation which may, if not for the present invention, lead to wedging of nested lids if adjacent lids are tilted and laterally displaced.

Several different features of the ribs 60 are useful in preventing jamming of tilted, laterally displaced lids. Referring now to FIGS. 3 and 4, ribs 60 have upper surfaces 66 extending from the inside surface **20*b* of sidewall 20. Surface 66 preferably extends parallel to the upper and lower major surfaces of the lid, that is, parallel to bottom wall 18 as well as top wall 38. The upper surface 66 of the rib is spaced from the upper surface 22***a* by a distance equal to the distance between the nesting shoulder 24*a* and bottom surface 18*a* of the bottom wall 18. Thus, when nested as in FIG. 4, the nesting shoulder 24*a* will engage the top wall surface 22*a* of a lid therebelow and simultaneously the bottom wall surface 18 will be resting on the upper surfaces 66 of the ribs 60 of a lid therebelow. The upper surface of ribs 60 extend inwardly and preferably radially inwardly for a distance several times greater than the thickness of the lid walls. For example, the upper surface 66 of the ribs illustrated in FIGS. 3 and 4 extend radially inwardly from the inner wall surface 20*b* by an amount approximately five times greater than the average thickness of the lid walls. With reference to FIG. 4, for example, the radially-directed inward length of ribs 60 is such as to prevent the downward insertion of the nesting shoulder 24*a* thereabove even though the cavity 62 has an enlarged considerably therebelow. According to one aspect of the present invention, the radially inward directed lengths of the upper surface of ribs 60 is large enough to ensure engagement with the lower outside corner of the lid's plug portion, generally designated by the numeral 68 (see FIGS. 3 and 4) even with a locally enlarged cavity portion due to an outward flexing of the pliable vertical wall 20. It will be appreciated that the expansion of the cavity diameter need only be a distance equal to the wall thickness to allow the nesting shoulder to drop down. Contact between the portions of the upper lid inserted in the central recess portion of a lower lid is limited to contact between the outside corner 68 of the upper lid and the upper surface 66 of ribs 60 of the lower lid. Thus, further penetration of the upper lid within the central cavity or recessed portion of the lower lid is effectively precluded.

Another feature of ribs 60 that prevents wedging of tiltably and laterally misaligned lids is the spacing of ribs 60 about the perimeter of the central recess portion 62. In particular, a plurality of equally spaced-apart ribs, having a relatively small width when viewed from above in plan view, are provided throughout substantially the entire periphery of recess portion 62. Thus, even if an upper lid were tiltably and laterally positioned so as to otherwise jam within the central recess of a lower lid, the points of engagement between that lid and ribs 60 would be limited essentially to points of contact and, for the example shown, the upper lid would usually engage at no more than six points of contact. As illustrated in the preferred embodiment, twelve ribs 60 are equally spaced about the periphery of central recess portion 62 of the lid. Although greater or fewer numbers of ribs may be employed, it is generally desirable to limit the number of ribs so as to allow ample spacing therebetween. A particular advantage of ribs 60 is their spacing, as indicated for example in FIGS. 1 and 2, it being recognized that one factor in defeating jamming resides in the irregular, non-smooth surface in the recessed central portion of the lid. Accordingly, the spacing of ribs 60 assures that an annular surface or the like is not made available for possible wedged interengagement with a superior lid.

A particular advantage of the anti-wedging means of the present invention is that the ribs require relatively little plastic and not interfere with the long smooth plug wall sealing surface 20*a*. It is generally preferred that the upper rib surface 66 extend parallel to bottom wall 18 and top wall 38, so that maximum protection against jamming is realized, while maximizing the downward spacing below the lid upper surface. Downwardly and inwardly sloping upper surfaces are generally not preferred, since some amount of anti-jamming protection is compromised. However, there may be occasions when such rib construction is preferred, and can be provided according to the present invention. Similarly, inwardly and upwardly sloping upper rib surfaces may be provided according go the present invention, but generally are not preferred, for the reasons given above. Although ribs 60 allow an upper lid to contact part of the upper end of cylindrical wall 20, wedged engagement therewith is prevented by the radial length of the upper rib surface which prevents contact over substantial portions of the sidewall upper portion.

Referring again to FIGS. 3 and 4, it is generally desired that upper surface 66 of ribs 60 located at an intermediate position on sidewall 20, and it is preferred that the ribs be positioned approximately at a mid-height position of the cylindrical sidewall 20. However, the upper surface 66 could also be located at any point along the cylindrical sidewall 20 or even the frustoconical wall 30 as long as adequate contact is maintained with a superior lid, over a range of tilting and lateral offset thereof. The ribs 60 of the preferred embodiment have a generally vertically extending radially interior edge 70. In the preferred embodiment, ribs 60 extend downwardly to contact bottom wall 18, so as to receive support therefrom. This maximizes the rigidity of ribs 60, particularly against downwardly directed forces, those forces most likely to be applied by a superior lid when contacting the ribs. This force is in turn transmitted to the lower end 24*a* of the cylindrical wall which advantageously comprises the lower nesting surface of the lid. This arrangement ensures that a stack of lids will not be disturbed in their preferred nesting alignment. However, if desired, ribs 60 need not extend to the bottom wall 18 but may, alternatively, have lower portions spaced apart therefrom. For example, ribs 60 may be provided with a bottom edge extending radially outwardly from the inner edge 70 or, the ribs 60 may be generally triangular-shaped in side elevation wherein the generally vertical inner end 70 of the ribs would be replaced by a downwardly and outwardly extending end surface terminating at frustoconical wall 30, for example.

By way of example only and not limitation, a preferred lid constructed according to the principles of the present invention will now be described. The lid was preferably injection molded of 0.020 inch thick L.L.D.P.E. polyethylene material except for the areas of increased cross-sectional thickness such as at the lid skirt bead 46. The vertical height of skirt 42 (as measured from top wall 38 to the bottom free end thereof) was 0.156 inch. The vertical height of cylindrical wall 20 from the top edge 22*a* to the offset 34 is 0.212 inches, while the vertical height of the conical portion 30, as measured from the offset 34 to the bottom wall 18 is 0.148 inches. Ribs 60 have a height of 0.230 inches from their upper surface 66 to the bottom wall 18, and have a radially inwardly-directed distance of 0.125 inches. The diameter of the central recess portion 62, as measured with respect to the inside surface 20*b* of sidewall 20 is 4.19 inches, approximately 33 times greater in length than the upper surface 66 of ribs 60. Manifestly, other shapes and sizes of the ribs and central recess portion of the lid may be used and fall within the terms of this invention. For example, the ribs 60 may have a triangular side elevational configuration as explained above, or the lid may have a non-circular shape when viewed from above. The lid could, for example, have a generally rectangular configuration, with or without rounded corners. The preferred injection molded plastic is polyethylene which has a moisture resistance of several times that of the thermoformed styrene and hence makes for a better protective material for many dairy products than does styrene. Also, the thermoformed walls are typically only about 0.010 or 0.011 inch thick and the preferred wall thickness herein is double that thickness to give better shelf life characteristics. However, given the ratio between the wall thickness and the diameter of central recess portion 62, the lids can, without the rib means of the present invention, become wedged together, especially when constructed of the preferred L.L.D.P.E. polyethylene material.

As can be seen from the above, the ribs, which according to the present invention, extend from the cylindrical sidewall, provide anti-jamming protection for lids that are pliable and expandable in localized areas. The ribs and nesting surfaces cooperate to improve the alignment and stability of lids nested together in a stack.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. An injection molded plastic closure for application to a container having a sidewall with a rim at its upper end defining an open mouth, said closure comprising:

a top central circular panel for covering an open container;

a plug-like portion upwardly extending from the central circuit panel, for insertion into the open mouth of the container for sealing engagement with the container sidewall, said plug-like portion having a generally upright sidewall defining an upwardly-facing cavity bounded at its upper end by an upper portion of said sidewall; an encircling rim on the closure extending radially outwardly from the upright sidewall and having an outer depending skirt;

a bead on the skirt for locking engagement with the container rim; and a plurality of spaced-apart rib means inwardly extending from said upright sidewall for contact with another plug-like portion of another closure at a plurality of spaced contact points when the other plug-like portion is inserted within said cavity, so as to prevent a wedged engagement of said other closure with said sidewall, said upright wall having a substantially vertical upper wall portion and a lower wall portion offset radially inwardly from the vertical upper wall portion, a lateral offset portion interconnecting the upper wall portion and the offset lower wall portion, a lower nesting surface on the bottom side of the lateral offset portion, and an upper nesting surface on the top of the vertical upper wall portion, said lower nesting surface engaging the upper nesting surface of another closure stacked therebelow and the upper surface on said closure engaging a lower nesting surface of a closure thereabove to stack the vertical upper wall portions of adjacent stack closures in a vertical column.

2. The closure of claim 1 wherein said rib means extend along a lower portion of said upper vertical wall portion of said sidewall and a substantial portion of said lower wall portion.

3. The closure of claim 2 wherein said rib means extend to said central circular panel and are joined thereto so as to receive support therefrom.

4. The closure of claim 1 wherein said rib means include an upper closure-engaging surface extending generally parallel to said top central panel, said rib means engaging the underside of a central panel of a closure thereabove to provide support radially inwardly of the vertical column.

5. The closure of claim 4 wherein said upper surface of said rib means extends from said cylindrical side wall in a generally radially inward direction.

6. The closure of claim 5 wherein said rib means include an interior edge extending between said rib means upper surface and said central panel in a direction substantially parallel to said cylindrical sidewall.

7. The closure of claim 1 in which the lower wall portion is nested closely adjacent an upper wall portion of a closure nested therebelow, said nested wall portions being capable of abutting with slight lateral sliding movements of the nested closures.

* * * * *